United States Patent [19]

Otsuka et al.

[11] Patent Number: 4,927,356

[45] Date of Patent: May 22, 1990

[54] GAS BURNER

[75] Inventors: Tetsuji Otsuka, Neyagawa; Kenichi Shinozaki, Kashiwara; Kenji Toyoyama, Fujiidera; Shinobu Ishihara, Kawachinagano, all of Japan

[73] Assignee: Osaka Gas Co., Ltd., Osaka, Japan

[21] Appl. No.: 88,124

[22] Filed: Aug. 21, 1987

[30] Foreign Application Priority Data

| | | | |
|---|---|---|---|
| Aug. 22, 1986 | [JP] | Japan | 61-197848 |
| Dec. 27, 1986 | [JP] | Japan | 61-199926[U] |
| Dec. 27, 1986 | [JP] | Japan | 61-199927[U] |
| Apr. 2, 1987 | [JP] | Japan | 62-81967 |
| Apr. 2, 1987 | [JP] | Japan | 62-81968 |
| Apr. 3, 1987 | [JP] | Japan | 62-83578 |

[51] Int. Cl.[5] ..... F23D 15/00

[52] U.S. Cl. ..... 431/351; 431/350; 431/352

[58] Field of Search ..... 431/350–352

[56] References Cited

U.S. PATENT DOCUMENTS

| | | | |
|---|---|---|---|
| 3,178,161 | 4/1965 | Yeo et al. | 431/351 X |
| 3,494,711 | 2/1970 | Spielman | 431/165 |
| 3,575,543 | 4/1971 | Weatherston | 431/285 |
| 4,388,064 | 6/1983 | Kaplan et al. | 431/265 |
| 4,523,905 | 6/1985 | Lewis | 431/351 |
| 4,573,907 | 3/1986 | Coppin et al. | 431/351 |
| 4,610,626 | 9/1986 | Kikutani et al. | 431/351 |

*Primary Examiner*—Alan Cohan
*Assistant Examiner*—Allen J. Flanigan
*Attorney, Agent, or Firm*—Gifford, Groh, Sprinkle, Patmore and Anderson

[57] ABSTRACT

A gas burner having flame openings adapted for discharging a mixture of gaseous fuel and primary combustion air supplied from an electric fan, and secondary air supply passages adapted for supplying secondary combustion air from the electric fan into a combustion space adjacent the flame openings. The gas burner is characterized by opposed combustion face forming wall members extending from the sides of the flame openings, in the mixed gas discharge direction and at the same time diverging outwardly with the secondary combustion air outlet openings formed continuously or intermittently along lines extended from both ends of the flame openings on the faces of the wall members towards the direction of mixed gas flow.

11 Claims, 15 Drawing Sheets

FIG. 24
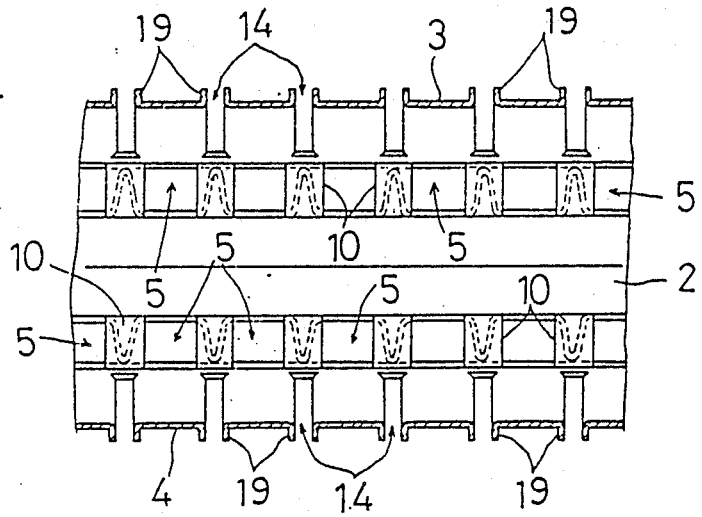
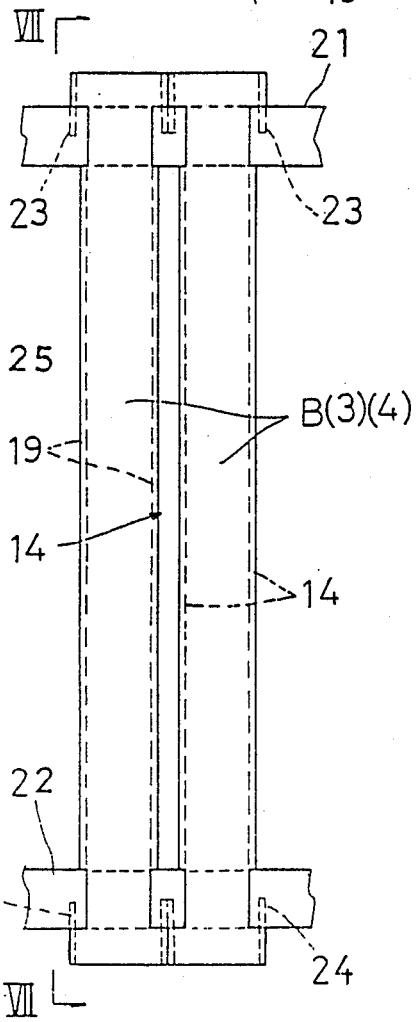
FIG. 25
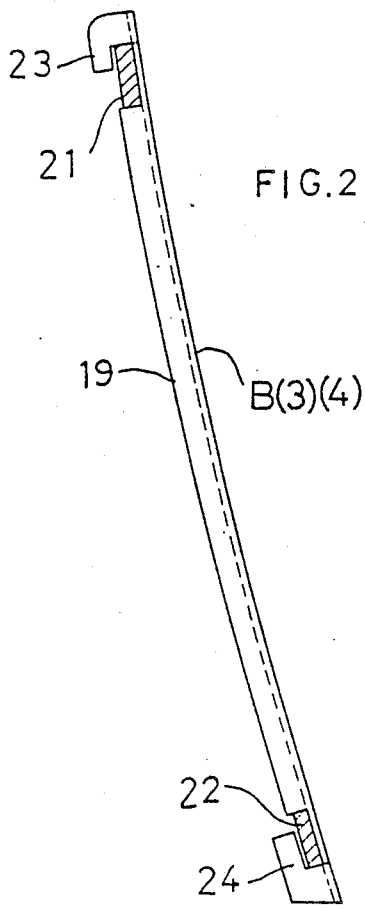
FIG. 26

GAS BURNER

FIELD OF THE INVENTION

The present invention relates to a gas burner comprising a flame opening for discharging a mixture of gaseous fuel and of primary air for combustion supplied from an electric fan and a secondary air supply passage for feeding secondary air for combustion supplied from the electric fan into a combustion space for the flame opening.

DESCRIPTION OF THE PRIOR ART

A conventional gas burner, which has a typical construction, is shown in FIGS. 29 and 30, comprises a plurality of nozzles 35 disposed in parallel with each other inside a casing 36 which opens upwardly e.g. in the direction of gas discharge. Each nozzle 35 serially defines a number of flame openings 37. A primary air supply passage 39 connected to an electric fan 38, and a gaseous fuel supply passage 40, are connected to mixing pipes 41 respectively attached to the nozzles 35. A secondary air supply passage 42 is connected to the electric fan 38 and also to a lower portion of the casing 36, whereby a mixture of gaseous fuel and air for combustion is discharged upwardly from the flame openings 37 to form flames with secondary air for combustion being supplied into the combustion space 43 for the flame openings 37 through a space between the casing 36 and the nozzles 35 and through spaces 44 between adjacent nozzles 35.

In the conventional gas burner of the above-described construction, with an increase of caloric value of the burner, the caloric value per specific area of each flame openings 37 also increases. However, since there is an upper limit in increasing this caloric value per specific flame opening area, it has been impossible thus far to obtain large caloric value with a compact burner. Moreover, there have been other problems associated with the increase of caloric value such as decrease of turn down ratio or increase of combustion noise.

SUMMARY OF THE INVENTION

Therefore, it is the primary object of the present invention to provide a gas burner which overcomes the above-described drawbacks of the prior art and is capable of generating a large caloric output in spite of its compactness and the burner further having large turn down ratio and low combustion noise regardless of changes in caloric value.

In order to achieve the above object, a gas burner of the present invention comprises a flame opening adapted for discharging a mixture of gaseous fuel and a primary combustion air supplied from an electric fan and a secondary air supply passage adapted for supplying secondary combustion air from the electric fan into a combustion space adjacent the flame opening and the gas burner is characterized by combustion face forming wall members extending from a side portion of the flame opening, disposed outwardly in the mixed gas discharge direction and at the same time diverging in the mixed gas discharge direction and by a secondary combustion air outlet opening formed continuously or intermittently along lines extended from both ends of one side edge portion of the flame opening on faces of the wall members and toward a direction of mixed gas flow.

BRIEF DESCRIPTION OF THE DRAWINGS

FIG. 24 is a view taken along a line III—III in FIG. 23, FIG. 25 is a partial side view showing still another embodiment of the gas burner related to the present invention, FIG. 26 is a view taken along a line VII—VII in FIG. 25.

DETAILED DESCRIPTION OF THE PREFERRED EMBODIMENTS

Figure 1:
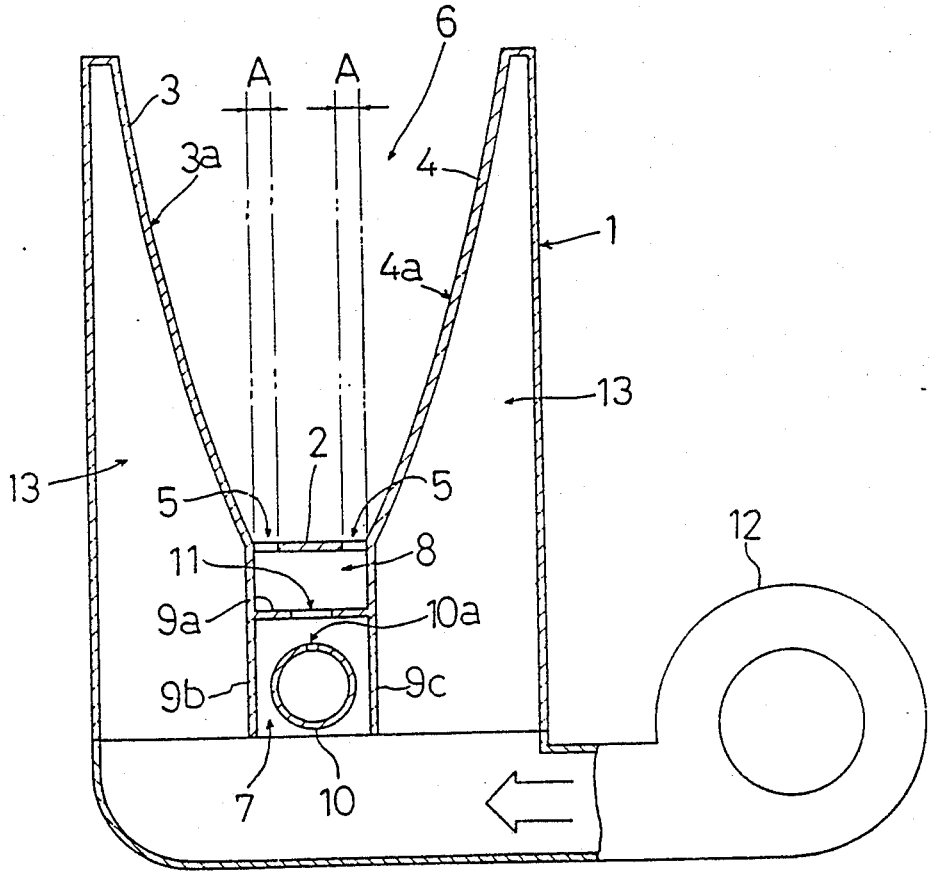
FIG. 1 is a cross section showing one embodiment of a gas burner related to the present invention.

Preferred embodiments of a gas burner related to the present invention will be particularly described hereinafter with reference to the accompanying drawings.

As shown in FIGS. 1 through 4, the gas burner of the present invention comprises a casing 1, a flame forming portion or base 2, a pair of combustion face forming wall members 3, 4 extending upwardly (in the direction of gas discharge) and diverging from respective side edges of the base 2 and rectangular-shaped flame openings 5 disposed at both sides of the flame forming section base 2 and having long sides thereof formed contiguous with the wall members 3 and 4 respectively. There is a plurality of flame openings 5 aligned serially with each other in a row and there is a combustion space 6 adjacent the flame openings 5 between opposing combustion faces 3*a*, 4*a* formed by the wall members 3, 4.

Figure 2:
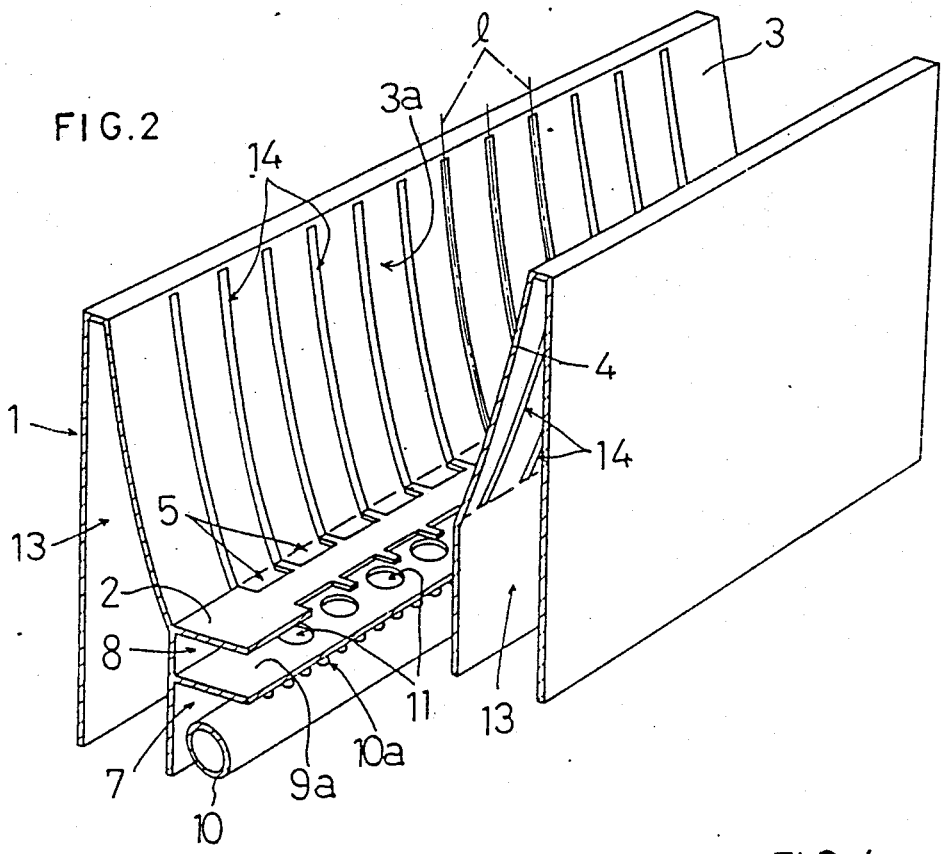
FIG. 2 is a partial perspective view of the gas burner of FIG. 1, FIGS. 3 and 4 are cross sections showing combustion conditions of the gas burner of FIG. 1.

Below the flame forming portion or base 2, there is provided a mixing chamber 8 communicating with the flame openings 5, and below the mixing chamber 8 there is provided a primary air supply passage 7. The mixing chamber 8 and the primary air supply passage 7 are formed by partition walls 9*a*, 9*b*, 9*c*. The inside of the primary air supply passage 7 is connected with an electric fan 12, and a gaseous fuel pipe 10 is provided within the primary air passage 7 having a plurality of gas discharge openings 10*a* which are disposed upwardly to be dispersed over the whole length of two arrays of flame openings. The partition wall 9*a* separating the primary air supply passage 7 from the mixing chamber 8 defines air supply openings 11. These air supply openings 11, as shown in FIG. 2, are disposed, in plane view, between adjacent flame openings and at the same time are aligned in the direction of the flame opening array. In operation, the gaseous fuel supplied from the supply pipe 10 and a primary air for combustion supplied from an electric fan 12 are pre-mixed in the mixing chamber 8 and this mixed gas is discharged upwardly from the flame openings 5.

Behind the respective wall members 3, 4 inside the casing 1, there are provided secondary air supply passages 13 connected with the electric fan 12. The wall members 3, 4 are respectively disposed outwardly of mixed gas discharge areas 'A' of the flame openings 5 and at the same time the wall members 3, 4 are inclined in such a way as to gradually diverge from the mixed gas discharge areas 'A' in the leading direction of mixed gas discharge. Further, the wall members 3, 4 respectively define a plurality of slit type outlet openings 14 for the secondary air supply passages 13. These slit type outlet openings 14 are disposed along lines l extending from the longitudinal ends of the flame openings 5 in a direction of mixed gas flow on the face of the wall member 3 or 4, with adjacent flame openings 5 in the array direction thereof co-utilizing the outlet opening 14 positioned therebetween.

In operation secondary air for combustion supplied from the electric fan 12 is fed through the slit type outlet openings 14 into the combustion space 6 to burn the mixed gas discharged from the flame openings 5 thereby forming flames from the flame openings 5. Further, high-temperature gas still containing unburned ingredients is caused to rise along the wall members 3, 4 to be mixed with the secondary air for combustion supplied through the outlet openings 14 thereby burning the unburned ingredients in the high-temperature gas, with flame 'F' being formed closely along the combustion faces 3*a*, 4*a* of the wall members 3, 4.

Figure 3:
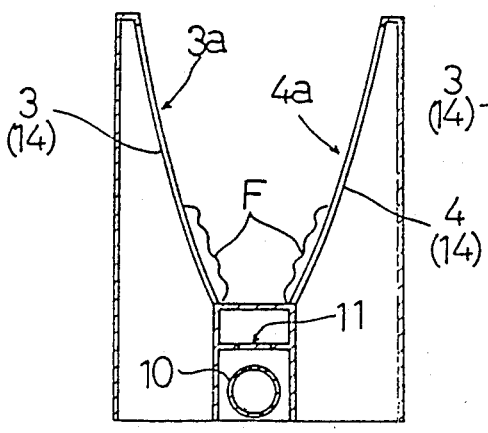
Figure 4:
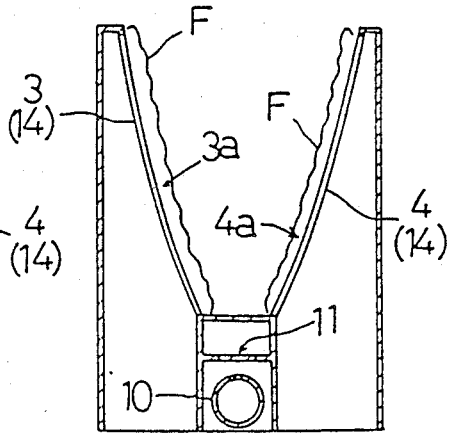

In the case of low gas input, as shown in FIG. 3, the flame 'F' has its top edge formed at lower portions of the wall members 3, 4. With an increase of gas input, the top edge of the flame 'F' extends further upwardly along the wall members 3, 4. In the case of high gas input, as shown in FIG. 4, the flame 'F' extends along the whole length of or close to the top portions of the wall members 3, 4 and the combustion faces 3*a*, 4*a* of the wall members 3, 4 act as apparent flame openings. As the result, an apparent flame opening area drastically decreases or increases in proportion to the gas input, whereby it becomes possible to minimize unfavorable variations of caloric value per apparent flame opening area in spite of large changes in the gas input. Consequently, the gas burner related to the present invention, despite its compactness, i.e. the actual small flame opening area thereof, is capable of generating a considerably larger caloric value with much larger turn down ratio and low combustion noise.

It is to be noted here that the construction for feeding the mixture of the gaseous fuel and of the primary air for combustion into the flame openings 5 may be conveniently modified.

Alternate embodiments of the gas burner related to the present invention will be described next.

Figure 5:
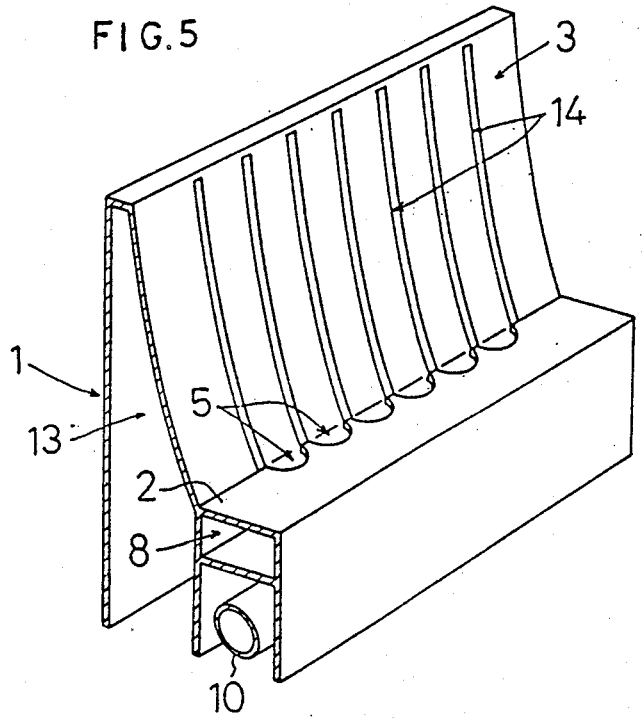
FIG. 5 is a partial perspective view showing another embodiment of the gas burner related to the present invention.

The number, arrangement, shape and the like of the flame openings 5 may be modified if convenient. For instance, as shown in FIG. 5, the group of flame openings 5 may be aligned in a single line with a single wall member 3, or the flame openings 5 may have a semi-circular shape.

Figure 6:
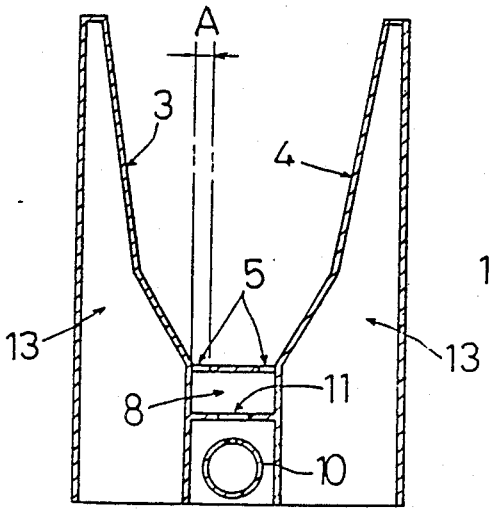
FIG. 6 is a cross section showing still another embodiment of the gas burner related to the present invention.
Figure 7:
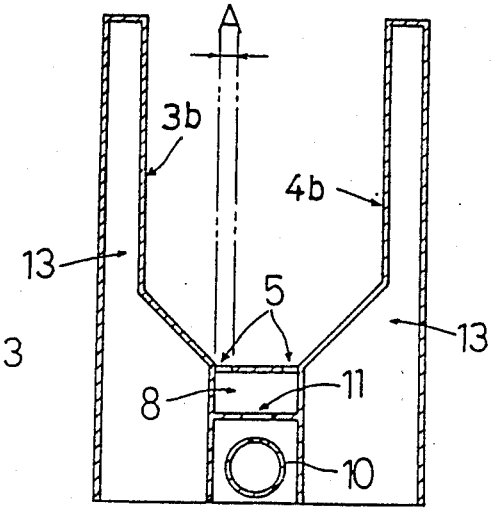
FIG. 7 is a cross section showing further embodiment of the gas burner related to the present invention.

The shape of the combustion face forming wall members 3, 4 extending upwardly from the side edge portions of the flame openings 5 may also be conveniently modified. For example, as shown in FIG. 6, the wall members 3, 4 may be formed as bent plates, or may include vertical portions 3*b*, 4*b* as shown in FIG. 7.

Figure 8:
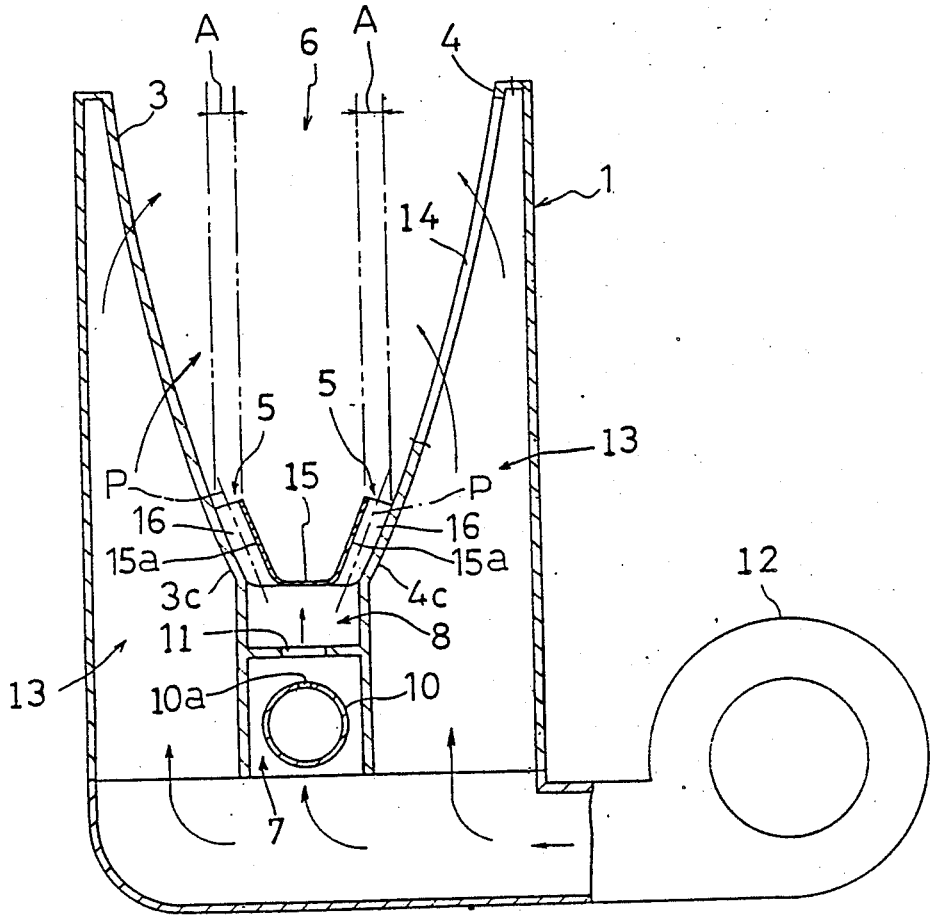
FIG. 8 is a cross section showing still another embodiment of the gas burner related to the present invention.
Figure 9:
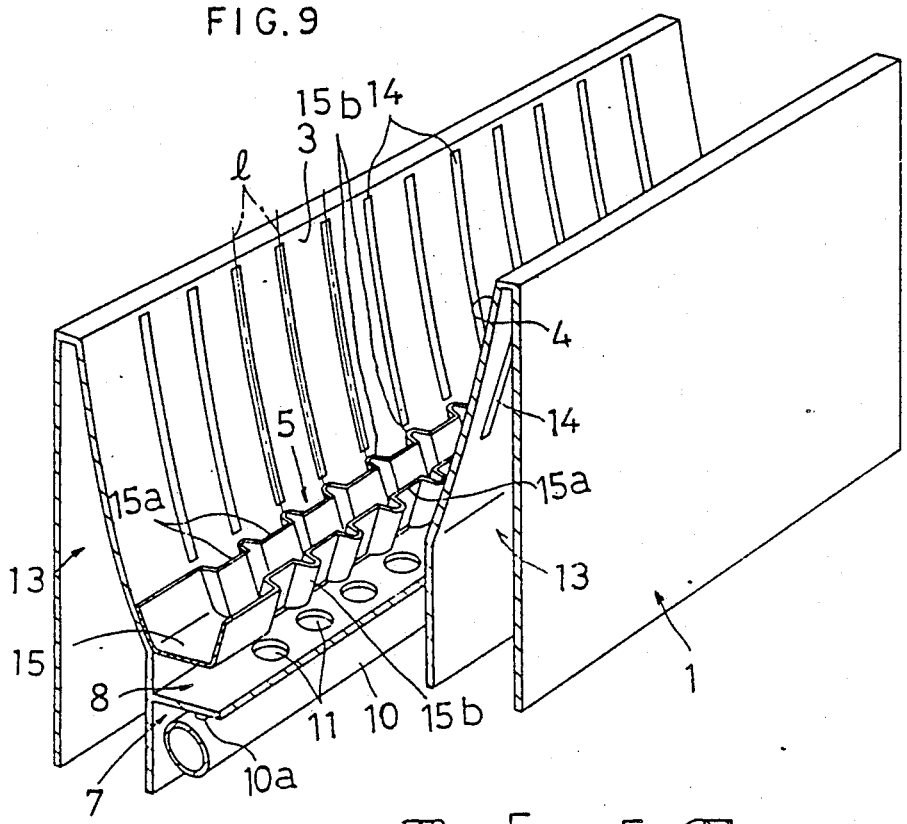
FIG. 9 is a partial perspective view showing the gas burner of FIG. 8.
Figure 10:
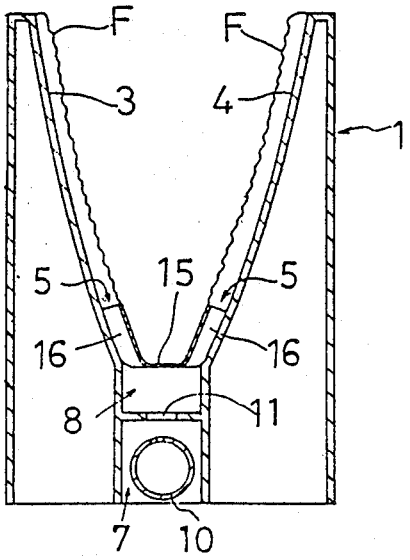
FIG. 10 is a cross section showing a combustion condition of the gas burner of FIG. 8.

The flame openings 5, as shown in FIGS. 8 through 10, may be formed by top end openings of flow passages 16 respectively having a V-shaped cross section viewed in the flame opening array direction. More particularly, a bent plate type guide member 15 including at both sides of its V-shaped configuration alternately long concave portions 15*a* and short convex portions 15*b* in the direction of flame opening array, is disposed with each convex portion 15*b* being tangential contact with the faces of downwardly extending portions 3*c*, 4*c* of the combustion face forming wall members 3, 4 and disposed between these downwardly extending portions 3*c*, 4*c*. As the result, the plurality of flow passages 16 communicating with the mixture chamber 8 are formed by the respective concave portions 15*a* and the wall faces of the downwardly extending portions 3*c*, 4*c* with the protions 15*a* and the wall faces being separated from each other by means of the convex portions 15*b*, and the top end portions of these flow passages 16 are formed as the flame openings 5. In this arrangement of the flame openings 5, the respective flow passages 16 having an axis 'P' upwardly extending along the respective wall members 3, 4 are formed as mixed gas discharge guide passages for properly orienting the mixed gas discharged from the respective flame openings 5.

In operation, with the mixed gas discharged upwardly from the respective flame openings 5 and with the secondary combustion air supplied through the slit type outlet openings 14 defined in the respective wall members 3, 4, the flame 'F' is formed close to the wall faces of the wall members 3, 4, and further with the gas mixture discharge guide passages 16 properly orienting the gas mixture discharged from the flame openings 5 to be close to the faces of the wall members 3, 4, the mixed gas may smoothly rise along these faces of the wall members 3, 4. Moreover, these gas mixture discharge guide passages act also to prevent unfavorable spiral movements of the gas mixture in the course of discharge thereof, whereby the close contact of the flame with the wall faces of the wall members 3, 4 may be constantly maintained, the combustion noise may be reduced and further oscillating combustion associated with a reduced excess air ratio may be advantageously prevented. Accordingly, the gas burner having the above-described construction produces only very little combustion noise.

Moreover, since the oscillating combustion associated with the reduced excess air ratio is prevented, it becomes possible to further extend the adjustable calory capacity range and also to reduced the amount of combustion air (especially the primary combustion air), whereby the constructions of the combustion air supply and of gas mixture supply, and consequently the whole burner may be formed compact.

Figure 11:
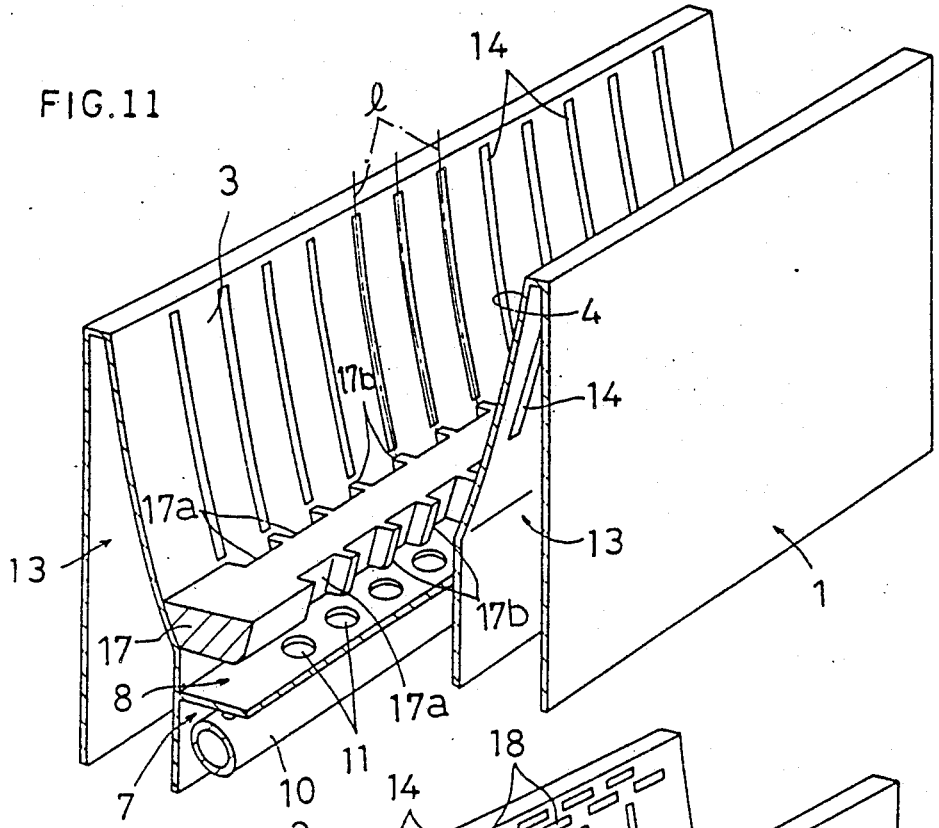
FIG. 11 is a partial perspective view showing still another embodiment of the gas burner related to the present invention.

The gas mixture discharge guide passages may be also formed as shown in FIG. 11. That is, a block member 17 alternately including concave portions 17*a* and convex portions 17*b* at both sides of the mixed gas discharge guide passages may be disposed between adjacent downwardly extending portions 3*c* and 4*c* of the respective combustion face forming wall members 3, 4. Further, the specific construction for arranging the mixed gas discharge guide passages defining the flame openings 5 at one side thereof and having its axis extending upwardly along the wall faces of the wall members 3, 4 may be advantageously modified in many ways.

Figure 12:
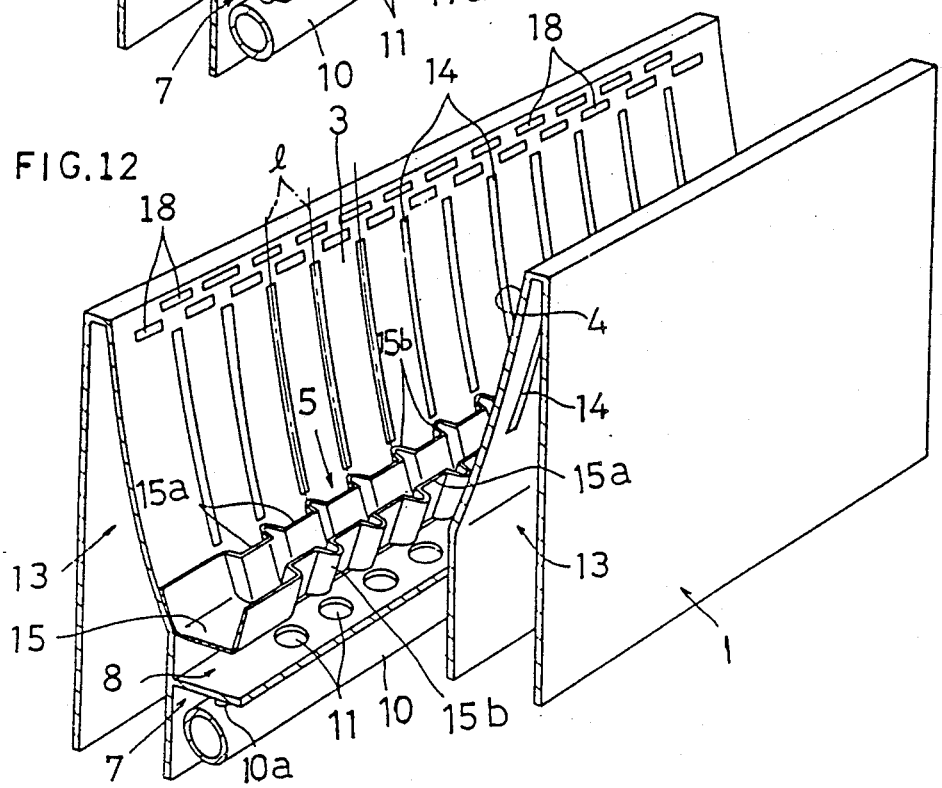
FIG. 12 is a partial perspective view showing still another embodiment of the gas burner related to the present invention.
Figure 13:
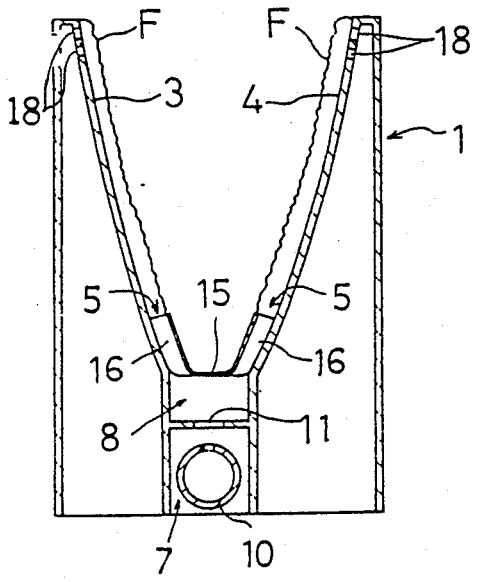
FIG. 13 is a cross section showing a combustion condition of the gas burner of FIG. 12.

Furthermore, as shown in FIGS. 12 and 13, auxiliary outlet openings 18 for the secondary combustion air communicating with the secondary air supply passages 13 may be formed at the top side end portions of the wall members 3, 4 in the direction of the mixed gas flow.

More particularly, these auxiliary outlet openings 18 are adapted for discharging the secondary combustion air toward the surfaces of the wall members 3, 4 and are disposed in upper and lower arrays in the direction of the flame opening array such that some of the openings 18 may be positioned between the adjacent virtual lines l of secondary air slit type outlet openings 14.

Figure 14:
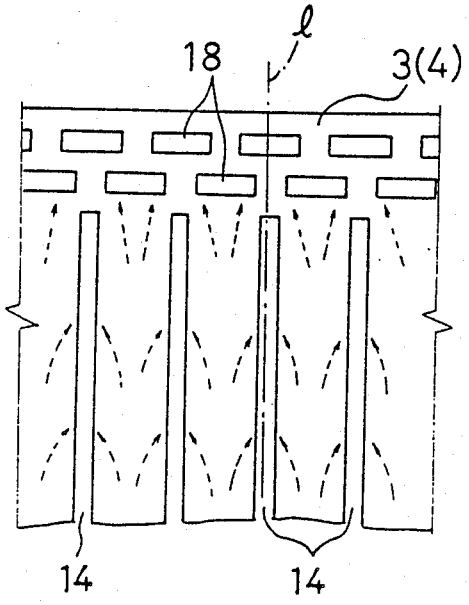
FIG. 14 is a side view showing flow conditions of secondary combustion air of the gas burner of FIG. 12.

With this arrangement, the secondary combustion air is discharged both from the slit type outlet openings 14 and from the auxiliary outlet openings 18, whereby the flame 'F' is formed closely along the respective wall faces of the combustion face forming wall members 3, 4 as shown in FIG. 13. And, since the secondary combustion air, as indicated by broken arrows in FIG. 14, flow upwardly along back faces of the wall members 3, 4 inside the combustion space 6, the secondary combustion air is cooled through the back faces of the wall members 3, 4, whereby a so-called burning phenomenon at the top end portions of the wall members 3, 4 may be conveniently prevented. In other words, in the case of the constructions of the previous embodiments, there somtimes occurs the burning phenomenon at the top side end portions of the wall members 3, 4 in the direction of the mixed gas flow because of the close contact of the flame with the wall faces of the wall members 3, 4. This is because there is a scarcity of the secondary combustion air flow behind the wall faces at portions between adjacent virtual lines l at the top side end portions of the wall members 3, 4 in the direction of the gas mixture flow. This burning phenomenon results in reduced life of the burner and requires special material for forming the combustion face forming wall members 3, 4. This phenomenon appears more conspicuously when using rapid-burning types of gas.

If the auxiliary outlet openings 18 are formed at the top side end portions of the wall members 3, 4 in the direction of the mixed gas flow as described hereinbefore, the life of burner may be considerably extended and no special material is needed for forming the wall members 3, 4, whereby it becomes possible to provide a gas burner of lower manufacturing and running costs. Further, it also becomes possible to use the rapid-burning types of gas without entailing any troubles, whereby the application range of the burner may be also extended.

The secondary air discharged from the auxiliary outlet openings 18 is to be used in the post-discharge combustion.

Figure 15:
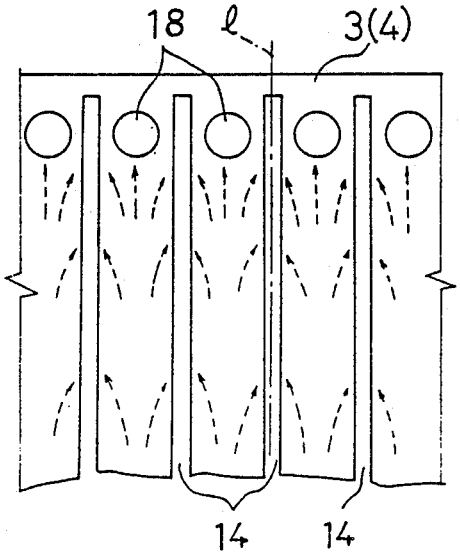
FIG. 15 is a side view showing flow conditions of secondary combustion air of the gas burner of still another embodiment of the present invention.

The configuration and specific arrangement of the auxiliary outlet openings may be modified in many ways from those shown in FIG. 12. For instance, as shown in FIG. 15, one or plurality of auxiliary outlet openings 18 may be provided between the adjacent slit type outlet openings 14 at the top side end portions of the wall members 3, 4 in the direction of the mixed gas flow. The arrangement of the auxiliary outlet openings may be modified in many other ways, and also the shape of the same may be formed rectangular, circular, semi-circular or as a slit and so on. Further, the number of the auxiliary outlet openings formed between the adjacent virtual lines may be changed conveniently.

The ratio between the secondary combustion air discharged from the slit type outlet openings and the secondary combustion air discharged from the auxiliary outlet openings may be conveniently decided.

Figure 16:
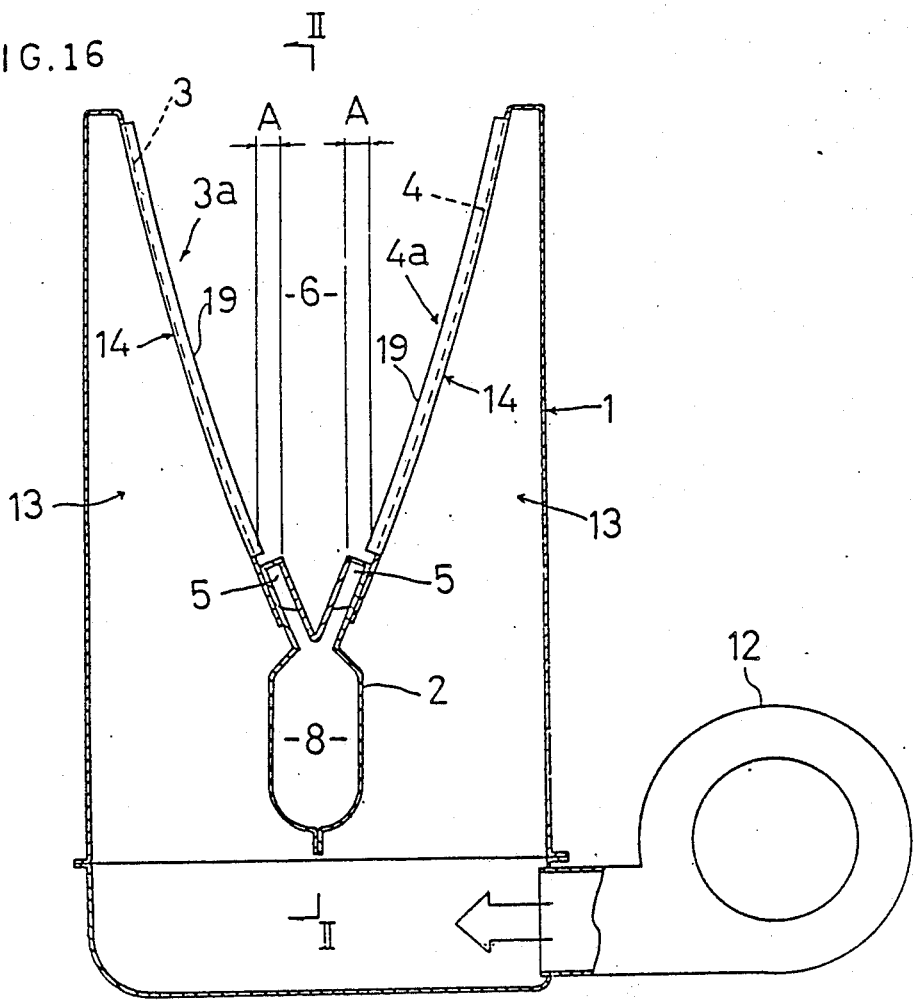
FIG. 16 is a cross section showing still another embodiment of the gas burner related to the present invention.
Figure 17:
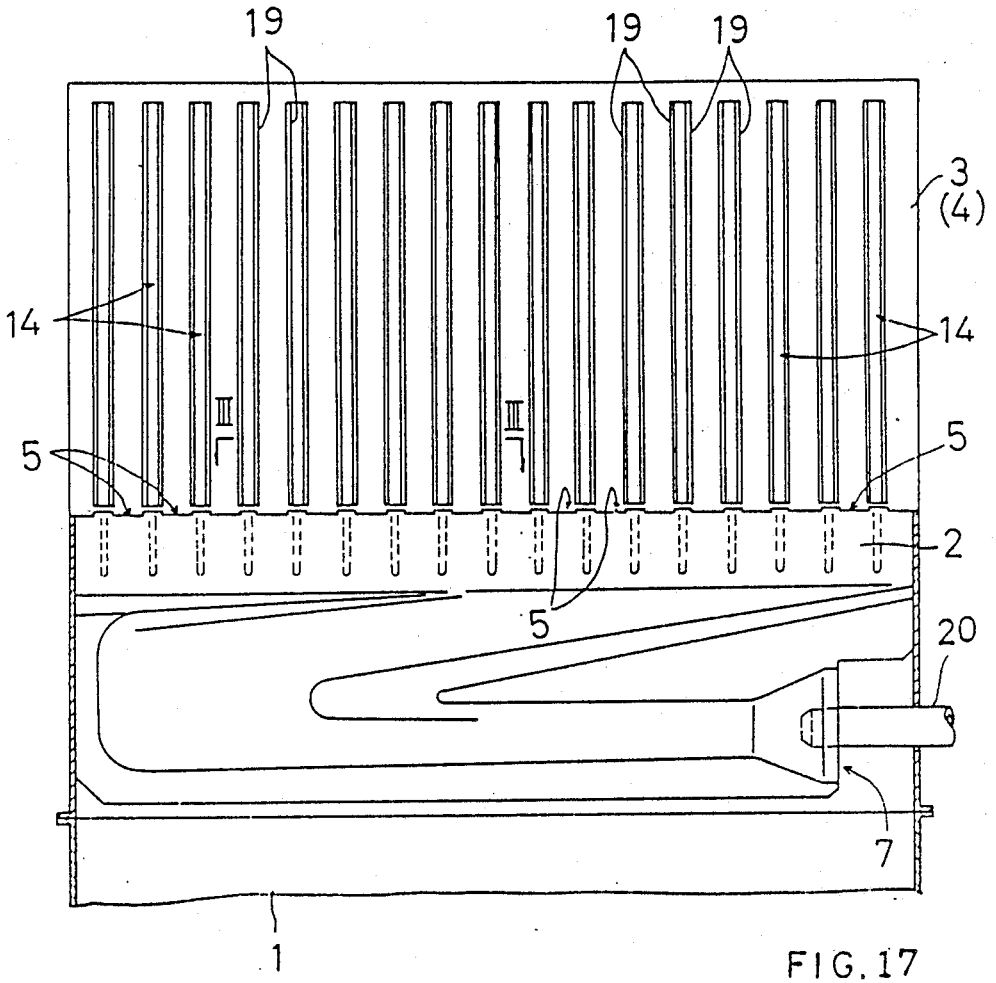
FIG. 17 is s view taken along a line II—II in FIG. 16.
Figure 18:
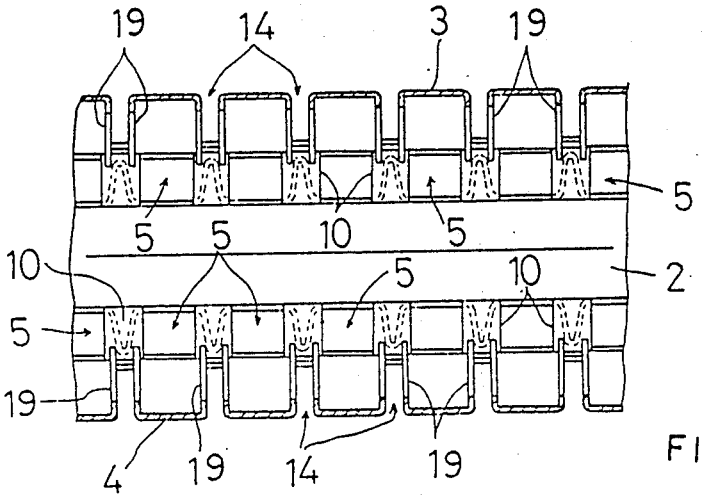
FIG. 18 is a view taken along a line III—III in FIG. 17.

At the right and left sides of the respective slit type outlet openings 14 of the combustion face forming wall members 3, 4, as shown in FIGS. 16 through 18, guides 19 projecting toward the combustion space 6 may be vertically and serially or intermittently disposed.

More specifically, the guides 19 projecting toward the combustion space 6 are attached to the wall members 3, 4 along the whole right and left length of the respective outlet openings 14, whereby the mixed gas discharged upwardly from the flame openings 5 is rectified as being guided by the right and left guides 19 and at the same time the secondary combustion air discharged through the outlet openings 14 into the combustion space 6 is also rectified by the right and left guides 19. These guides 19 are bent-formed through a pressing together with the combustion face forming wall members 3, 4 for forming the outlet openings 14.

With the above-described arrangement, the mixed gas discharged upwardly through the flame openings 5 is caused to flow upwardly along the wall members 3, 4 in a controlled manner as being rectified by the guides 19. Accordingly, the mixed gas may be smoothly and gradually mixed with the secondary combustion air and the combustion noise may be further reduced. Moreover, these guides 19 serve also to reinforce the wall members 3, 4 preventing damages to the wall members 3, 4 due to thermal distortions and consequently the life of the gas burner may be further extended.

In FIG. 17, a reference numeral 20 denotes a nozzle for feeding the gaseous fuel through the primary air supply opening 7 into the mixing chamber.

Figure 19:
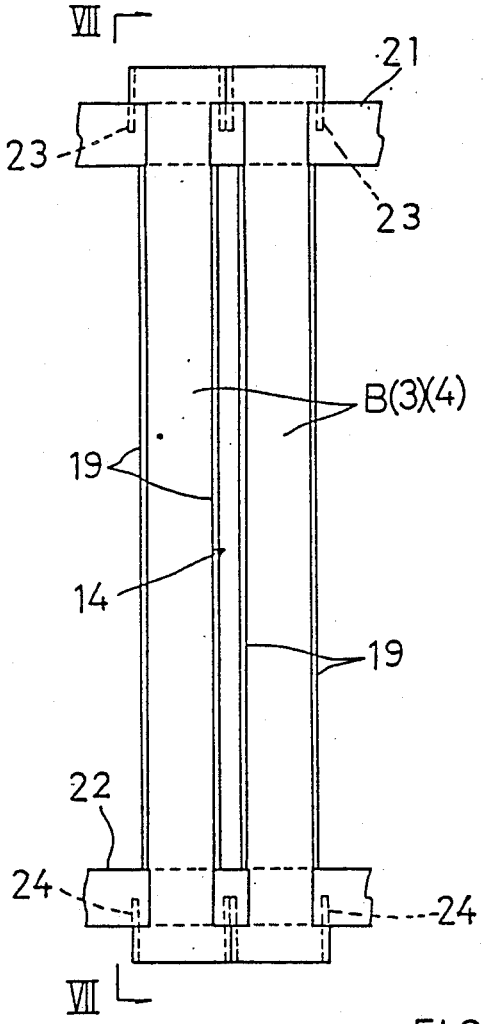
FIG. 19 is a partial side view showing still another embodiment of the gas burner related to the present invention.
Figure 20:
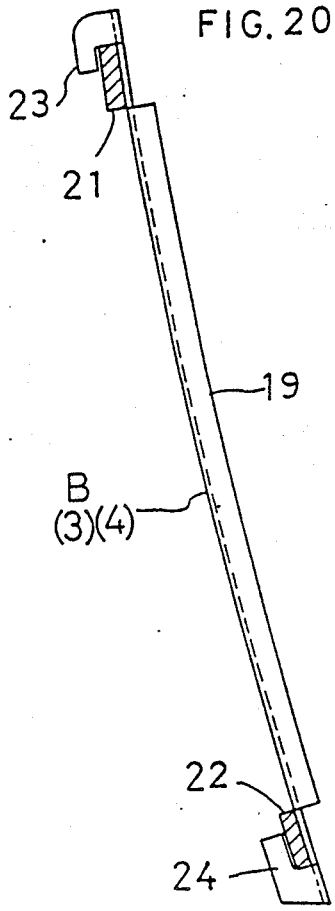
FIG. 20 is a view taken along a line VII—VII in FIG. 19.
Figure 21:
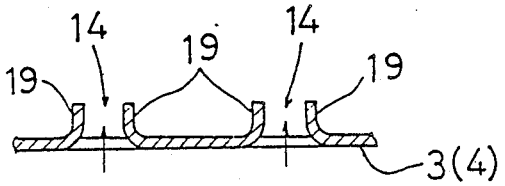
FIG. 21 is a partial cross sectional view showing still another embodiment of the gas burner related to the present invention.

Furthermore, as shown in FIGS. 19 and 20, the combustion face forming wall members 3, 4 may be formed of a plurality of separate members 'B' disposed in parallel to each other. Upper and lower engaging portions 23, 24 of the respective separate members 'B' are engaged with upper and lower band type engaging members 21, 22 having a casing thereby bent-forming guides 19 at right and left sides of the respective separate members 'B'. This arrangement is advantageous in that it is easy to obtain optimum combustion condition because the height or the shape of the guides 19 may be freely designed. For example, the guides 19 may be vertically and intermittently extended so as not to extend over the whole length of the outlet openings 14. Or, the guides 19 may be formed independently of the combustion face forming wall members 3, 4, or as shown in FIG. 21, it is also possible to enlarge the curvature radius of the base portion of the guides 19 so as to enhance the rectifying effect thereof.

Figure 22:
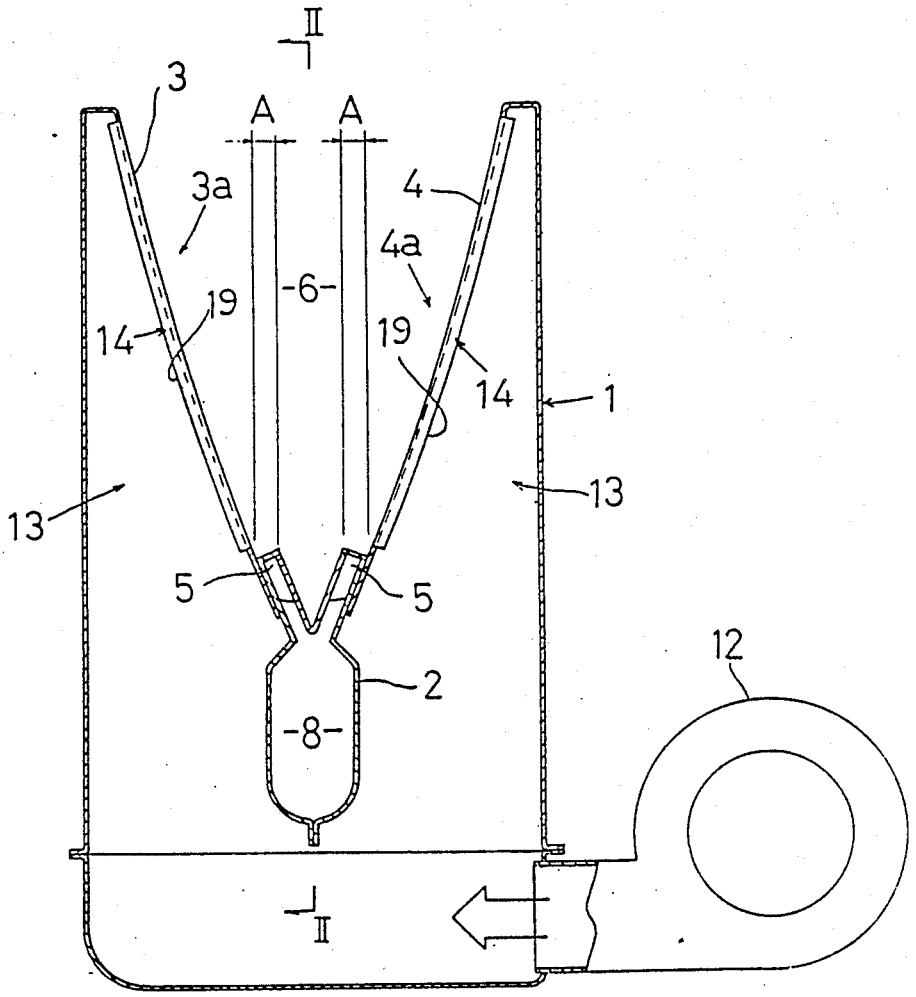
FIG. 22 is a cross section showing still another embodiment of the gas burner related to the present invention.
Figure 23:
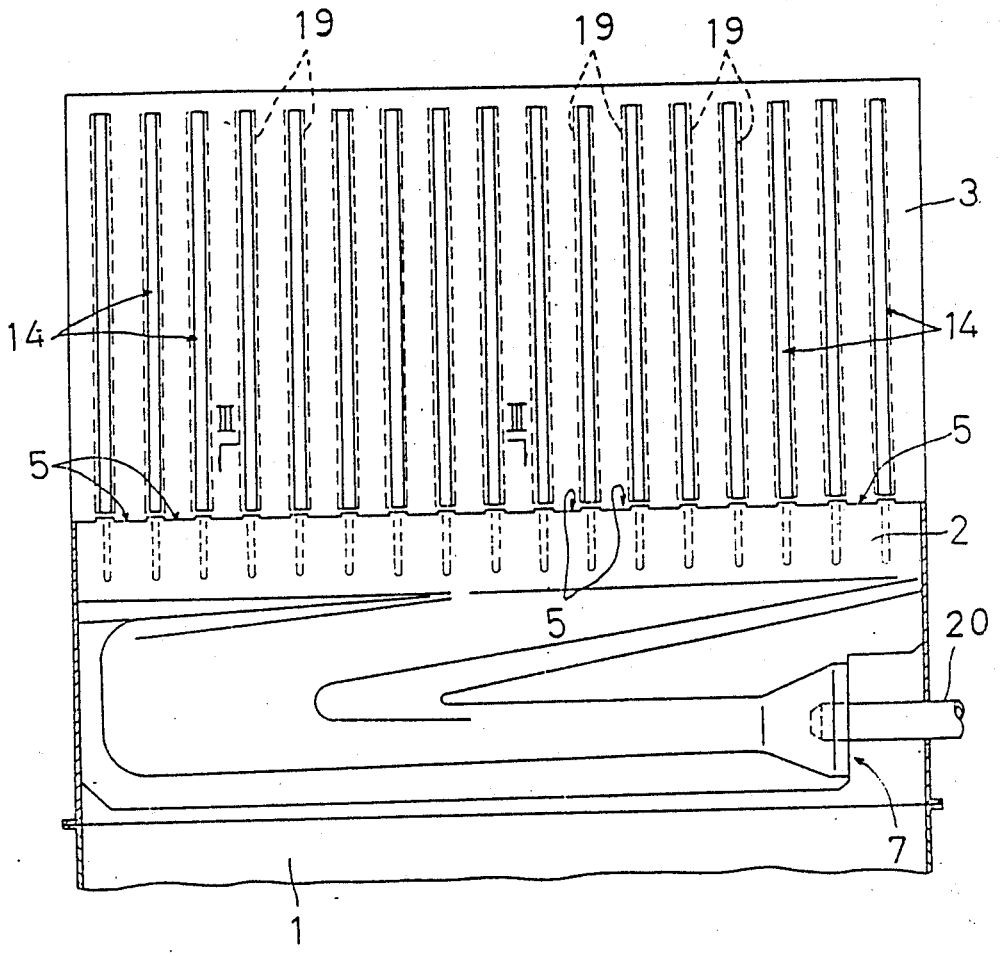
FIG. 23 is a view taken along a line II—II in FIG. 22.

In contrast to the embodiment shown in FIG. 16, at the right and left sides of the respective slit type outlet openings 14 of the wall members 3, 4, the guides 19 can project toward the secondary combustion air supply passages 13 extending upwardly continuously or intermittently, as shown in FIGS. 22 through 24.

With this arrangement, the secondary air discharged through the outlet openings 14 into the combustion space 6 may be rectified by the right and left guides 19 and at the same time the secondary air may be uniformly distributed for all of the outlet openings with unfavorable effects caused by the air flow directed toward the wall members constituted by the plurality of separate members 'B' being sufficiently checked by the guides. Accordingly, the gas mixture discharged upwardly through the flame openings 5 may be smoothly and gradually mixed with the secondary combustion air, further reducing the combustion noise. Also, this arrangement is as advantageous in its durability as that of the embodiment shown in FIG. 16.

Figure 27:
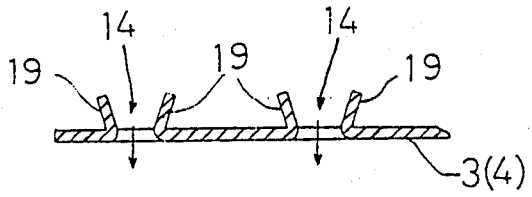
FIG. 27 is a partial cross sectional view showing still another embodiment of the gas burner related to the present invention.

As shown in FIGS. 25 and 26, the combustion face forming wall members 3, 4 may be formed by a plurality of separate members 'B' disposed in parallel to each other. Upper and lower engaging portions 23, 24 of the respective separate members 'B' are engaged with upper and lower band-type engaging members 21, 22, whereby guides 19 are bent-formed at the right and left sides of the respective separate members 'B' and the outlet openings 14 are formed between the adjacent separate members 'B'. This arrangement as well is advantageous in that it is easy to obtain the optimum combustion condition because the height or the shape of the guides 19 may be freely designed. The guides 19 may be formed to extend upwardly and intermittently so as not to extend over the whole length of the outlet openings 14. Further, the guides 19 may be formed independently of the combustion face forming wall members 3, 4, or as shown in FIG. 27, it is also possible to gradually narrow the space between the adjacent guides 19 toward the air discharge side.

As described above, the shape of the guides 19 may be modified in many different ways.

Figure 28:
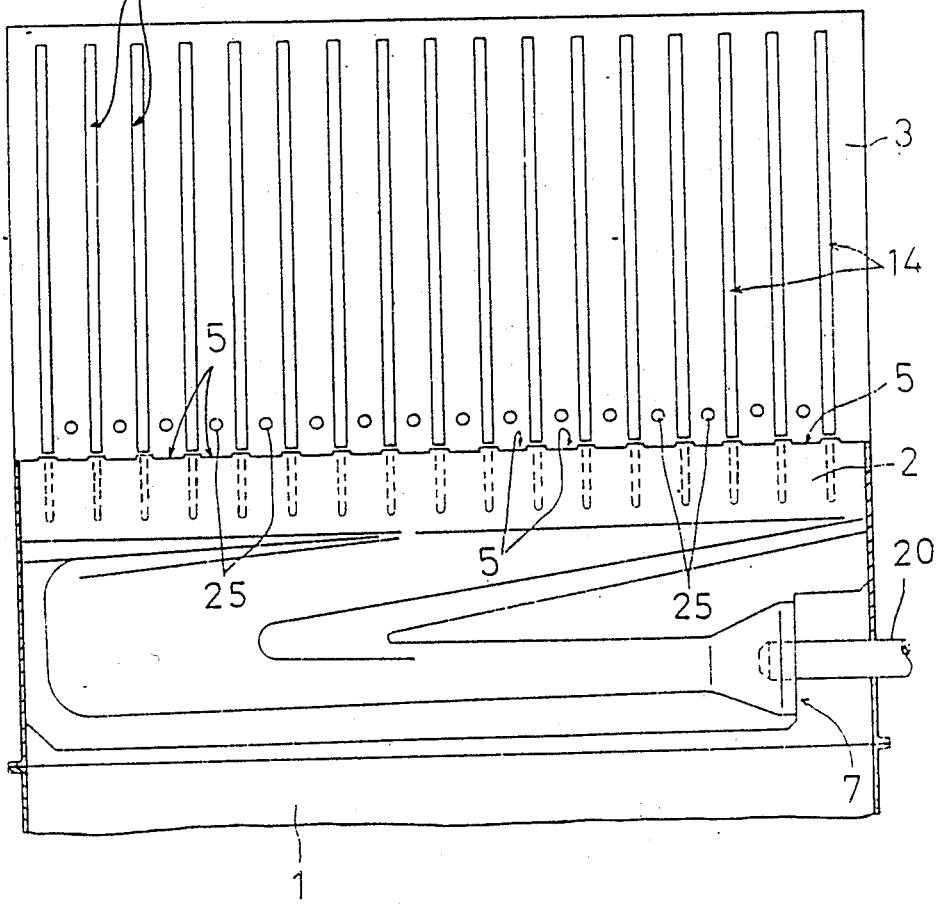
FIG. 28 is a partial cross sectional side view showing an improvement of the gas burner of FIG. 23.
Figure 29:
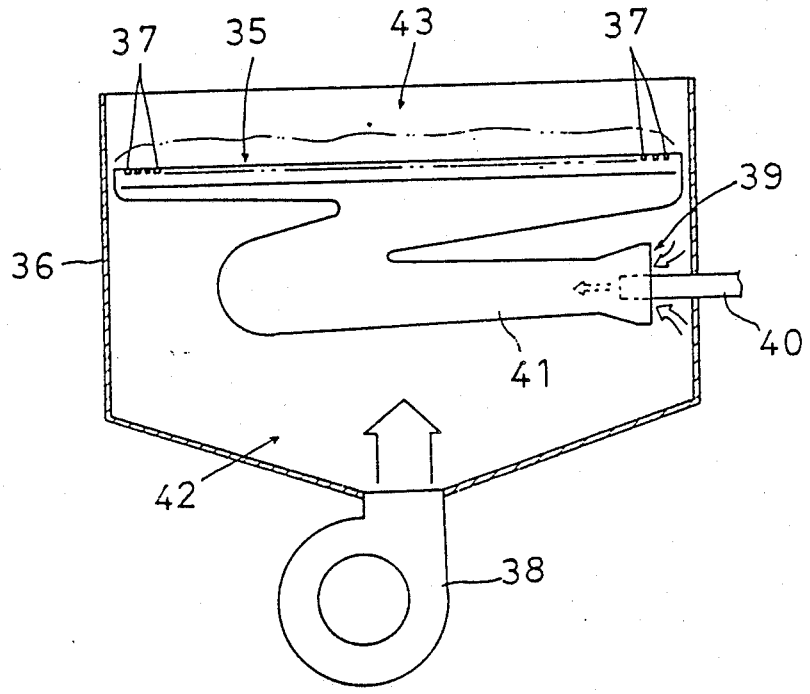
FIG. 29 is a cross section showing a conventional gas burner.
Figure 30:
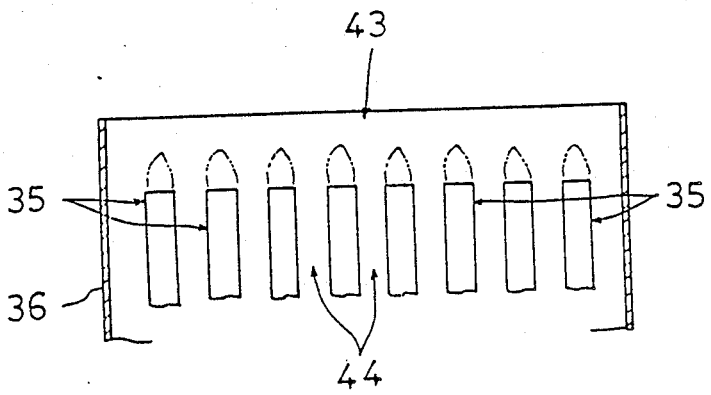
FIG. 30 is a partial side view of FIG. 29.

Further, as shown in FIG. 28, a plurality of lower flame air holes 25 communicating with the secondary air supply passages 13 may be defined in the combustion face forming wall members 3, 4, the holes 25 being disposed between the adjacent outlet openings 14 near the respective flame openings 5.

With this arrangement, in case the supply of the gas mixture discharged upwardly through the flame openings 5 is considerably reduced, without reducing or without considerably reducing the amount of the secondary air from the outlet openings 14, it is possible to sufficiently prevent lifting of the flame by the combustion of the gas mixture by the secondary air supplied from the lower air holes 25, thereby further increaseing the turn down ratio.

Also, the gas burner may be constituted by a plurality of the constructions described above in connection with the various embodiments, and the specific construction of the gas burner related to the present invention may be conveniently modified.

The gas burner related to the present invention is applicable for various types of gas such as city gas, natural gas, propane gas and so on.

Moreover, the gas burner of the present invention was disclosed with the discharge of the gas mixture being directed upwardly in the previous embodiments. In place of this; however, the burner may be disposed with its mixed gas discharge direction being horizontal, downward or inclined as well.

We claim:

1. A gas burner, havng a base 2 containing a plurality of spaced flame openings 5 for discharging from an elongate mixing chamber 8 a mixture of gaseous fuel and primary combustion air, said primary combustion air being supplied from an electric fan 12 directly to said mixing chamber 8, said gaseous fuel being supplied to said mixing chamber from a gaseous fuel supply means 10 having a plurality of evenly spaced openings for supplying gaseous fuel uniformly over the length of the mixing chamber 8, and a secondary air supply passage 13 for supplying secondary combustion air from said electric fan 12 into a combustion space 6 adjacent said flame openings 5, comprising:

a pair of wall members 3, 4, extending from said base 2 on opposite sides of said flame openings 5, defining therebetween said combustion space 6 extending in the discharge direction of said mixture; and a plurality of secondary combustion air outlet openings 14 defined in said wall members 3, 4 between adjacent flame openings 5 extending along the discharge direction of said mixture.

2. A gas burner, as defined in claim 1, wherein said secondary combustion air outlet openings 14 are formed as slits.

3. A gas burner, as defined in claim 1 wherein said flame openings 5 are aligned serially with said outlet openings 14 between adjacent flame openings 5 and said wall members diverging from each other in the discharge direction of said mixture.

4. A gas burner, as defined in claim 3, wherein said flame openings 5 are serially arranged in two parallel arrays and said wall members 3, 4 extend from opposite sides of said parallel arrays in defining said combustion space 6.

5. A gas burner, as defined in claim 1, wherein said flame openings 5 are formed as openings defined at end portions of mixed gas discharge guide passages 15 positioned along said wall members 3, 4.

6. A gas burner, as defined in claim 1, wherein said combustion face forming wall members 3, 4 respectively define at a leading side end portion thereof in the direction of mixed gas flow an auxiliary outlet opening 16 for the secondary combustion air communicating with said secondary air supply passage 13.

7. A gas burner, as defined in claim 1, wherein said wall members 3, 4 respectively include a guide 19 projecting toward said combustion space 6 on both sides of said respective outlet openings 14 to extend vertically and continuously or intermittently.

8. A gas burner, as defined in claim 1, wherein said combustion face forming wall members 3, 4 respectively include a guide 19 projecting toward said secondary air supply passage 13 and disposed at right and left sides of said respective outlet openings 14 to extend vertically and continuously or intermittently.

9. A gas burner, as defined in claim 7 wherein said outlet openings 14 for the secondary combustion air are formed as slits and said guides 19 are formed with said wall members 3, 4.

10. A gas burner, as defined in claim 7, wherein said combustion face forming wall members 3, 4 are constituted by a plurality of separate members 'B' aligned in parallel to each other with said outlet opening 14 for the secondary combustion air being provided between adjacent pair of said separate members 'B'.

11. A gas burner, as defined in claim 1, wherein said combustion face forming wall members 3, 4 respectively define a sub-flame air hole 25 communicating with said secondary air supply passage 13, said hole 25 being disposed between adjacent pair of said outlet openings 14 near said respective flame opening 5.

* * * * *